US010149510B2

(12) United States Patent
Zimmer

(10) Patent No.: US 10,149,510 B2
(45) Date of Patent: Dec. 11, 2018

(54) HELMET LINER

(71) Applicant: Trent Zimmer, Houma, LA (US)

(72) Inventor: Trent Zimmer, Houma, LA (US)

( * ) Notice: Subject to any disclaimer, the term of this patent is extended or adjusted under 35 U.S.C. 154(b) by 58 days.

(21) Appl. No.: 15/462,899

(22) Filed: Mar. 19, 2017

(65) Prior Publication Data

US 2017/0332720 A1 Nov. 23, 2017

Related U.S. Application Data

(60) Provisional application No. 62/280,123, filed on Jan. 19, 2016.

(51) Int. Cl.

| | |
|---|---|
| ***A42B 1/24*** | (2006.01) |
| ***A42B 3/10*** | (2006.01) |
| ***A42B 3/30*** | (2006.01) |
| ***A42B 3/16*** | (2006.01) |

(52) U.S. Cl.

CPC ..... *A42B 3/10* (2013.01); *A42B 1/245* (2013.01); *A42B 3/16* (2013.01); *A42B 3/30* (2013.01)

(58) Field of Classification Search

CPC .. A42B 3/166; A42B 3/16; A42B 3/00; A42B 1/245

See application file for complete search history.

(56) References Cited

U.S. PATENT DOCUMENTS

| | | | | | |
|---|---|---|---|---|---|
| 4,918,752 | A * | 4/1990 | Briggs | A42B 3/042 | 2/424 |
| 5,003,631 | A * | 4/1991 | Richardson | A42B 3/166 | 2/413 |
| 5,881,390 | A * | 3/1999 | Young | A41D 20/00 | 2/209.13 |
| 2011/0083240 | A1* | 4/2011 | Crye | A42B 3/085 | 2/2.5 |
| 2014/0047617 | A1* | 2/2014 | Abers | A42B 1/245 | 2/209.13 |
| 2014/0328508 | A1* | 11/2014 | Jacks | H04R 1/1008 | 381/376 |
| 2015/0041243 | A1* | 2/2015 | Ratliff | A42B 3/166 | 181/129 |
| 2017/0224041 | A1* | 8/2017 | Lovell | A42B 1/12 | |

* cited by examiner

*Primary Examiner* — Tajash D Patel

(74) *Attorney, Agent, or Firm* — F. Wayne Thompson, Jr.; Asgaard Patent Services, LLC

(57) ABSTRACT

Implementations of a helmet liner are provided. In some implementations, the helmet liner may be configured to be worn in conjunction with a helmet and/or a headset (e.g., a communication and/or hearing protection headset). In this way, the helmet liner may be used to provide localized thermal comfort for the wearer's head when a helmet and/or a headset is worn. In some implementations, the helmet liner may have a dome-like shape configured for anatomically fitting the head of a wearer. In some implementations, the helmet liner may comprise a front portion, a top portion, a back portion, a first side portion, and a second side portion. In some implementations, the helmet liner may further comprise a first slot and a second slot that extend through the first side portion and the second side portion, respectively.

17 Claims, 8 Drawing Sheets

HELMET LINER

CROSS REFERENCE TO RELATED APPLICATION

This application claims the benefit of U.S. Patent Application Ser. No. 62/280,123, which was filed on Jan. 19, 2016, and is incorporated herein by reference in its entirety.

TECHNICAL FIELD

This disclosure relates to implementations of a helmet liner.

BACKGROUND

Many military and law enforcement operations occur in cold weather environments. Current cold weather headgear does not effectively integrate with protective headgear (e.g., a helmet) and/or headsets (e.g., a communication and/or hearing protection headset) resulting in uncomfortable and ill-fitted helmets and/or headsets. This can contribute to an end user's inability to maintain situational awareness and compromise the functionality of the protective equipment.

Specifically, a helmet and cold weather headgear that do not effectively integrate may cause the following problems:

The orientation of the helmet on the wearer's head may change and thereby remove the protective shell of the helmet from desired coverage areas. The helmet, particularly a helmet having mission essential gear mounted thereon (e.g., a light, night vision equipment, electronic headset, etc.), will be less stable and more susceptible to shifting around when the wearer is moving. This could be both uncomfortable and distracting.

When positioned under a helmet, currently available cold weather headgear may bind and/or pull against the skin of the wearer, even rubbing portions of the head raw (e.g., the forehead). Some cold weather headgear is manufactured from material's which bind against and pull the wearer's hair during use.

Accordingly, it can be seen that needs exist for cold weather headgear that can be effectively integrated with protective headgear (e.g., helmets) and/or headsets. It is to the provision of such cold weather headgear (referred to herein as a "helmet liner") that the present invention is primary directed.

SUMMARY OF THE INVENTION

Implementations of a helmet liner are provided. In some implementations, the helmet liner may be configured to be worn in conjunction with a helmet and/or a headset (e.g., a communication and/or hearing protection headset). In this way, the helmet liner may be used to provide localized thermal comfort for the wearer's head when a helmet and/or a headset is worn.

In some implementations, the helmet liner may have a dome-like shape configured for anatomically fitting the head of a wearer. In some implementations, the helmet liner may comprise a piece of material having a front portion, a top portion, a back portion, a first side portion, and a second side portion.

In some implementations, the helmet liner may be configured to cover at least a portion of the forehead, left side, right side, back side, and/or crown of the head of a wearer.

In some implementations, the first side portion and the second side portion of the helmet liner may each extend to cover the left ear and the right ear, respectively, of the wearer. In some implementations, when the helmet liner is used in conjunction with a headset, the first portion and the second portion of the helmet liner may be sandwiched between the earcups of the headset and the ears of the wearer.

In some implementations, the back portion of the helmet liner may extend to cover the nape of the wearer's neck.

In some implementations, strips of hook and/or loop fasteners (e.g., Velcro®) may be positioned on and/or extend across the exterior side of the helmet liner. In this way, the helmet liner may be secured to the interior side of a helmet. In some implementations, the exterior side of the helmet liner may include one or more strips of hook and/or loop fasteners anywhere thereon that would correspond with a similarly positioned strip of hook and/or loop fasteners positioned on the interior side of a helmet.

In some implementations, the helmet liner may further comprise a first slot and a second slot that extend through the first side portion and the second side portion, respectively. In some implementations, the first slot and the second slot may each be configured so that a portion of the headband of a headset may pass therethrough. In this way, the headband does not interfere with the strips of hook and/or loop fastener(s) positioned on the exterior side of the helmet liner adhering to the corresponding strips of hook and/or loop fastener(s) positioned on the interior side of a helmet.

In some implementations, one or more strips of hook and/or loop fasteners (e.g., Velcro®) may be positioned on the interior side of the top portion of the helmet liner and/or the areas adjacent thereto. In this way, helmet comfort pads may be secured to the interior side of the helmet liner.

In some implementations, the helmet liner may be manufactured from Marino wool and/or polar fleece. In some implementations, the helmet liner may be manufactured from any synthetic, semi-synthetic, or natural fiber, or combination thereof, suitable for providing localized thermal comfort that is otherwise suitable for use as part of a helmet liner.

DETAILED DESCRIPTION

Figure 1A:
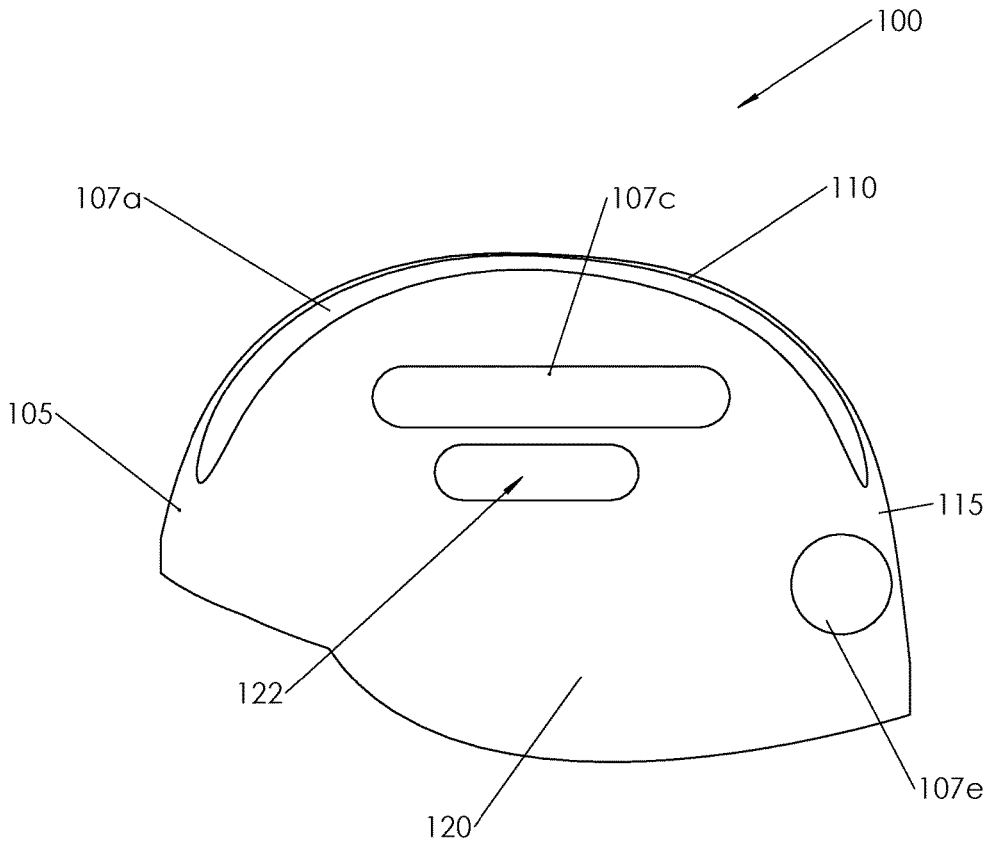
FIG. 1A illustrates a left side view of a helmet liner according to the principles of the present disclosure.

FIGS. 1A-1D illustrate an example helmet liner 100 according to the principles of the present disclosure. In some implementations, the helmet liner 100 may be worn in conjunction with a helmet 180 having helmet comfort pads 190 (see, e.g., FIGS. 2B and 2D). In some implementations, when worn in conjunction with a helmet 180 and/or a headset 185 (e.g., a communication and/or hearing protection headset), the helmet liner 100 may be configured to provide localized thermal comfort for the wearer's head. In this way, the helmet liner 100 may provide warmth and comfort to the wearer. In some implementations, the helmet liner 100 may be configured to allow the headband 187 of a headset 185 to pass therethrough without interfering with the integration of the helmet liner 100 and the helmet 180 (see, e.g., FIGS. 2A and 2C). In this way, a headset 185 (e.g., a communication and/or hearing protection headset) may be used in conjunction with a helmet 180 and a helmet liner 100.

Figure 1B:
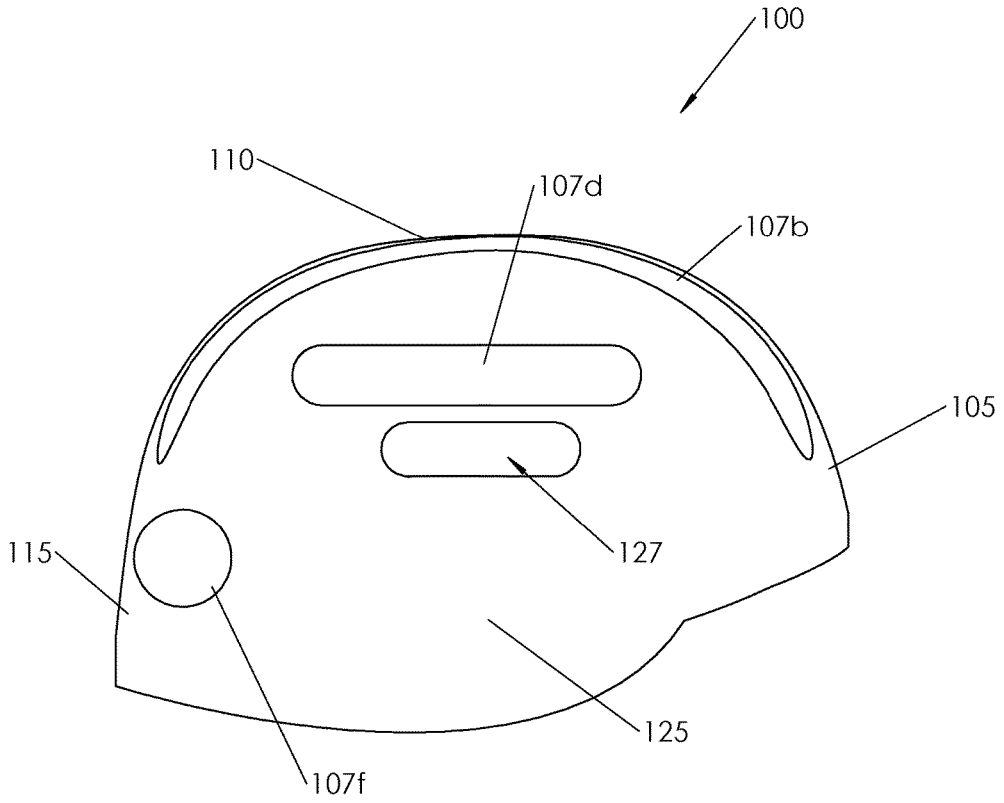
FIG. 1B illustrates a right side view of the helmet liner shown in FIG. 1A.

As shown in FIGS. 1A-1D, in some implementations, the helmet liner 100 may comprise a piece of material having a front portion 105 (see, e.g., FIG. 1D), a top portion 110 (see, e.g., FIG. 1A), a back portion 115 (see, e.g., FIG. 1C), a first side portion 120 (see, e.g., FIG. 1A), and a second side portion 125 (see, e.g., FIG. 1B). In some implementations, the helmet liner 100 may have a dome-like shape configured for anatomically fitting the head of a wearer.

In some implementations, the helmet liner 100 may be configured to cover at least a portion of the forehead, left side, right side, back side, and/or crown of the head of a wearer.

In some implementations, the first side portion 120 and the second side portion 125 of the helmet liner 100 may each extend to cover the left ear and the right ear, respectively, of the wearer. In some implementations, when the helmet liner 100 is used in conjunction with a headset 185, the first portion 120 and the second portion 125 of the helmet liner 100 may be sandwiched between the earcups 188*a*, 188*b* of the headset 185 and the ears of the wearer (see, e.g., FIG. 2C).

In some implementations, the back portion 115 of the helmet liner 100 may be configured to extend to cover the nape of the wearer's neck.

As shown in FIGS. 1A-1D, in some implementations, strips 107 of hook and/or loop fasteners (e.g., Velcro®) may be positioned on and/or extend across the exterior sides of the helmet liner 100. In this way, the helmet liner 100 may be secured to the interior side of a helmet 180 (see, e.g., FIG. 2B).

Figure 1C:
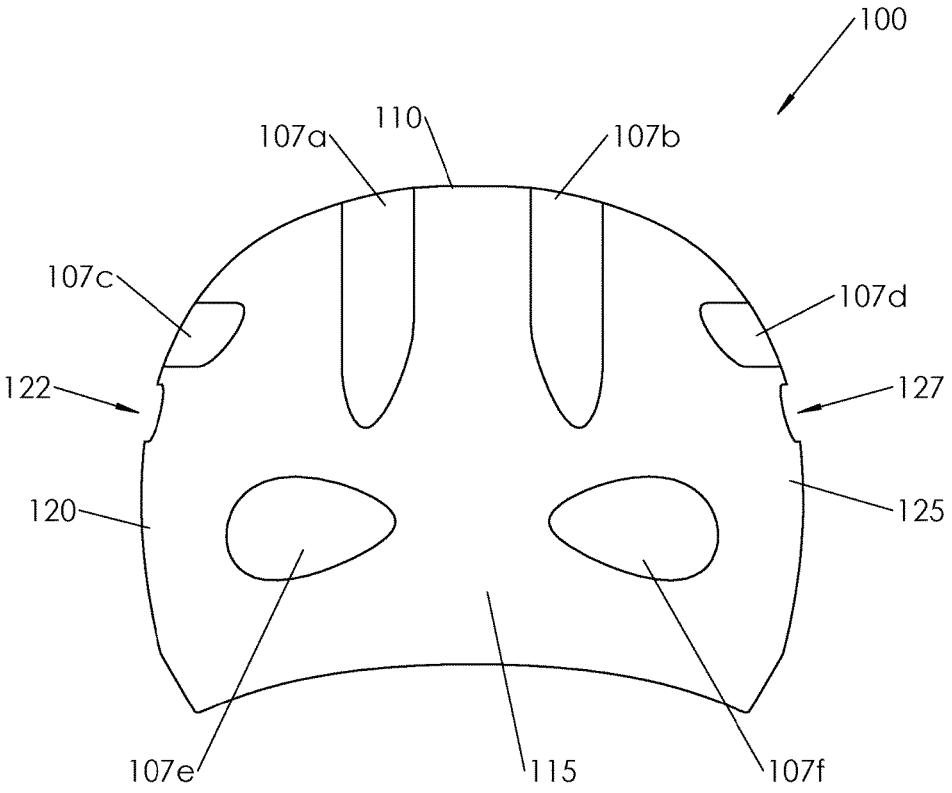
FIG. 1C illustrates a back side view of the helmet liner shown in FIG. 1A.
Figure 1D:
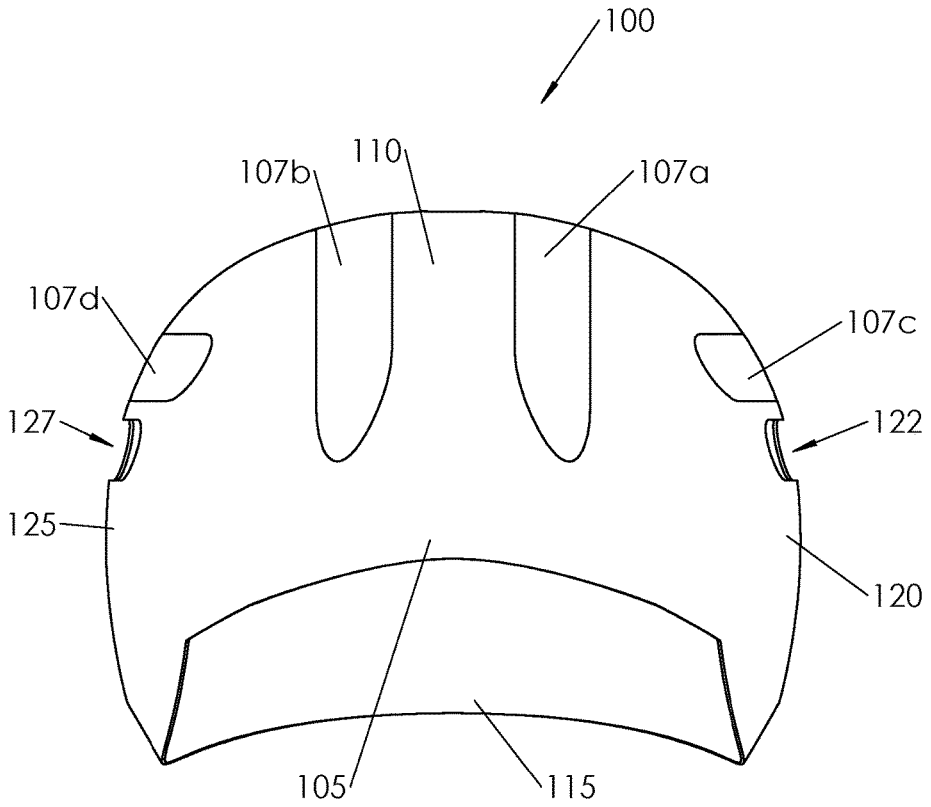
FIG. 1D illustrates a front side view of the helmet liner shown in FIG. 1A.
Figure 2A:
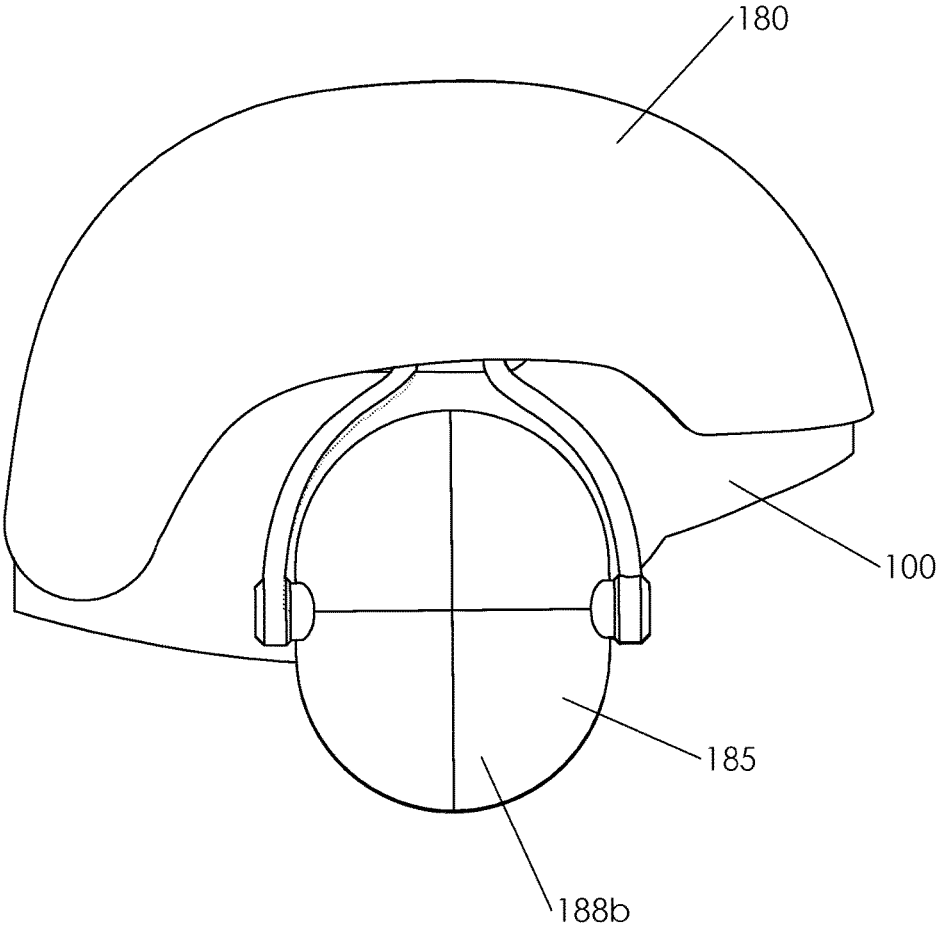
FIG. 2A illustrates a right side view of the helmet liner shown in FIG. 1A in conjunction with a helmet and a headset.

As shown in FIGS. 1C and 1D, in some implementations, a first strip 107*a* and/or a second strip 107*b* of hook and/or loop fasteners (e.g., Velcro®) may each extend from the front portion 105, over the top portion 110, to the back portion 115 of the helmet liner 100. In some implementations, the first strip 107*a* and the second strip 107*b* of fasteners may be parallel to each other (see, e.g., FIG. 1C). In some implementations, the first strip 107*a* and the second strip 107*b* of fasteners may not be parallel to each other.

As shown in FIG. 1A, in some implementations, the first side portion 120 of the helmet liner 100 may include a third strip 107*c* of hook and/or loop fasteners (e.g., Velcro®) thereon.

As shown in FIG. 1B, in some implementations, the second side portion 120 of the helmet liner 100 may include a fourth strip 107*d* of hook and/or loop fasteners (e.g., Velcro®) thereon.

As shown in FIG. 1C, in some implementations, the back portion 115 of the helmet liner 100 may further comprise a fifth strip 107*e* and/or a sixth strip 107*f* of hook and/or loop fasteners (e.g., Velcro®) thereon (see, e.g., FIG. 1C).

In some implementations, the exterior side of the helmet liner 100 may include one or more strips 107 of hook and/or loop fasteners anywhere thereon that would correspond with a similarly positioned strip of hook and/or loop fasteners positioned on the interior side of a helmet.

As shown in FIGS. 1A-1D and 2C, in some implementations, the helmet liner 100 may further comprise a first slot 122 and a second slot 127 that extend through the first side portion 120 and the second side portion 125, respectively. In some implementations, the first slot 122 and the second slot 127 may each be configured so that a portion of the headband 187 of a headset 185 may pass therethrough (see, e.g., FIG. 2C). In this way, the headband 187 does not interfere with the strips of fastener(s) (e.g., elements 107*a*, 107*b*, 107*c*, 107*d*) positioned on the exterior side of the helmet liner 100 adhering to the strips of fastener(s) (e.g., elements 182*a*, 182*b*) positioned on the interior side of the helmet 180 (see, e.g., FIG. 2B).

As shown in FIGS. 1A-1D, in some implementations, the third strip of fasteners 107*c* and the fourth strip of fasteners 107*d* may be positioned above the first slot 122 and the second slot 127, respectively. In some implementations, the third strip of fasteners 107*c* and the fourth strip of fasteners 107*d* may not be positioned above the first slot 122 and the second slot 127, respectively.

Figure 2B:
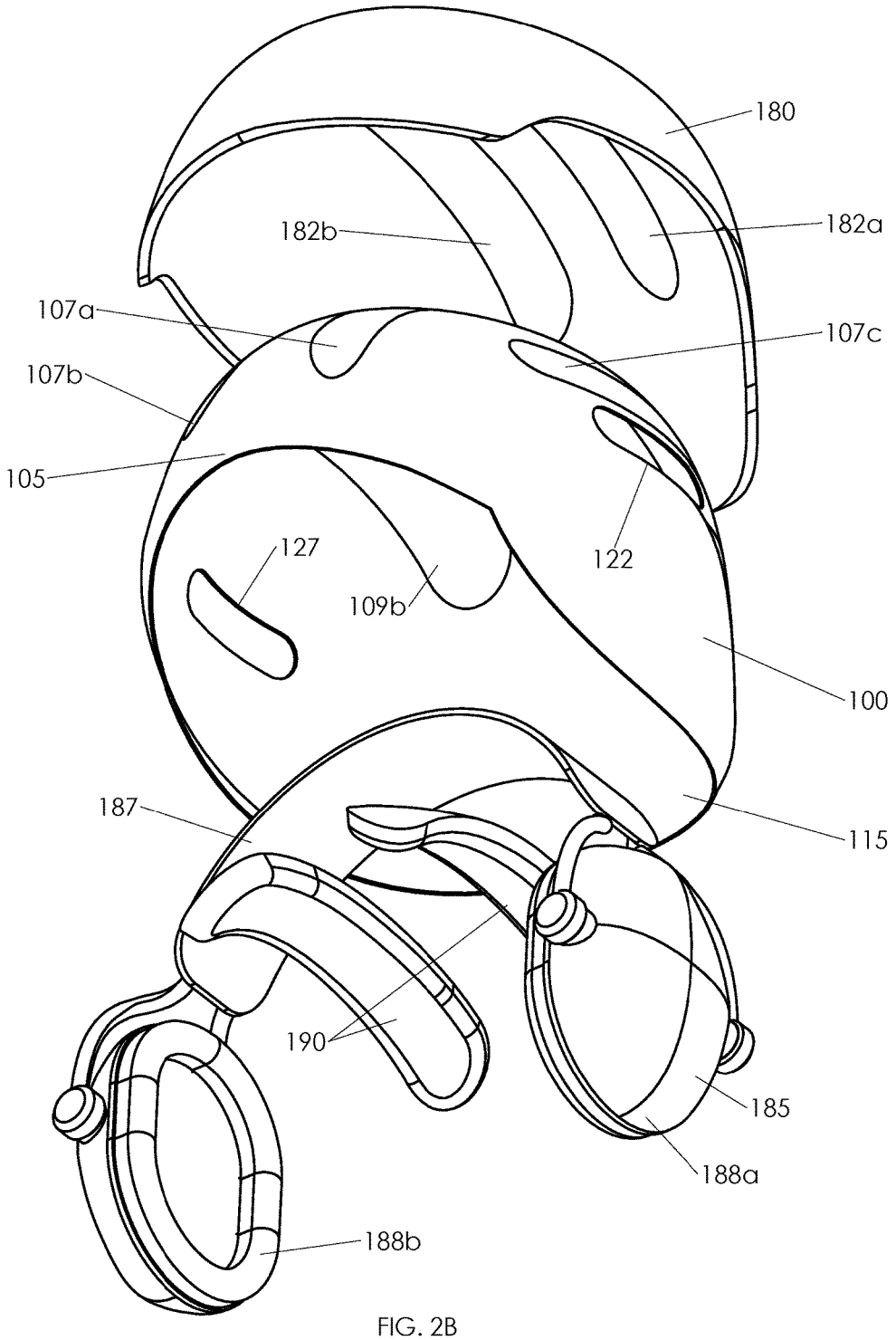
FIG. 2B illustrates an exploded view of FIG. 2A.
Figure 2C:
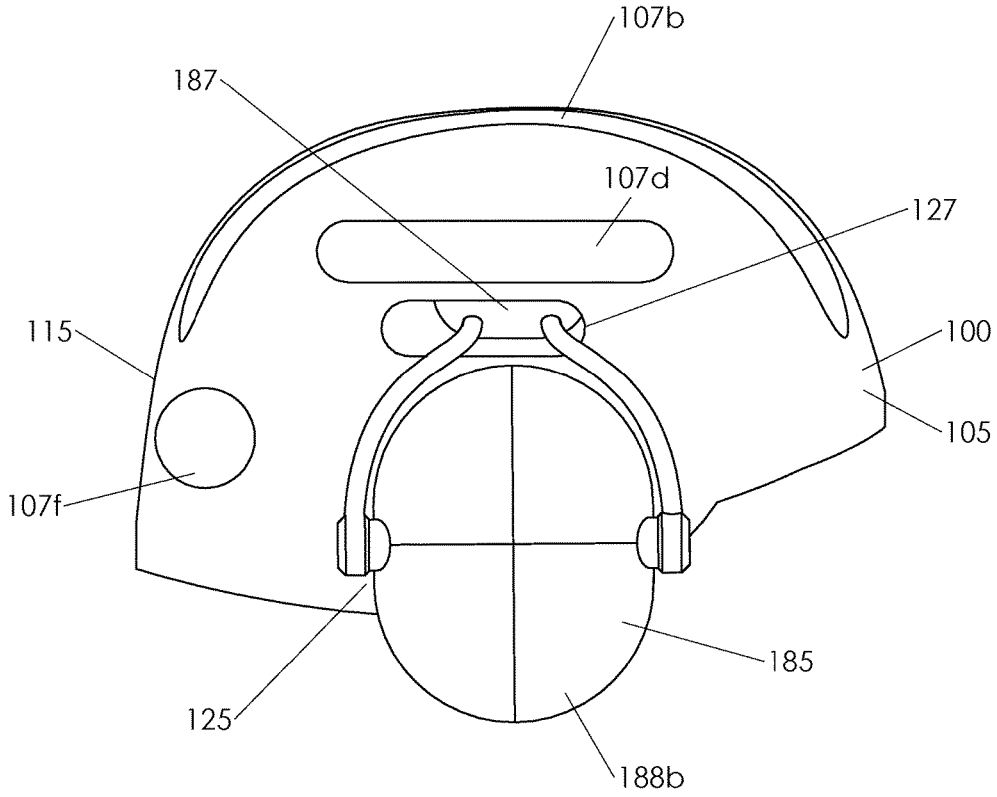
FIG. 2C illustrates a right side view of the helmet liner shown in FIG. 1A in conjunction with a headset.
Figure 2D:
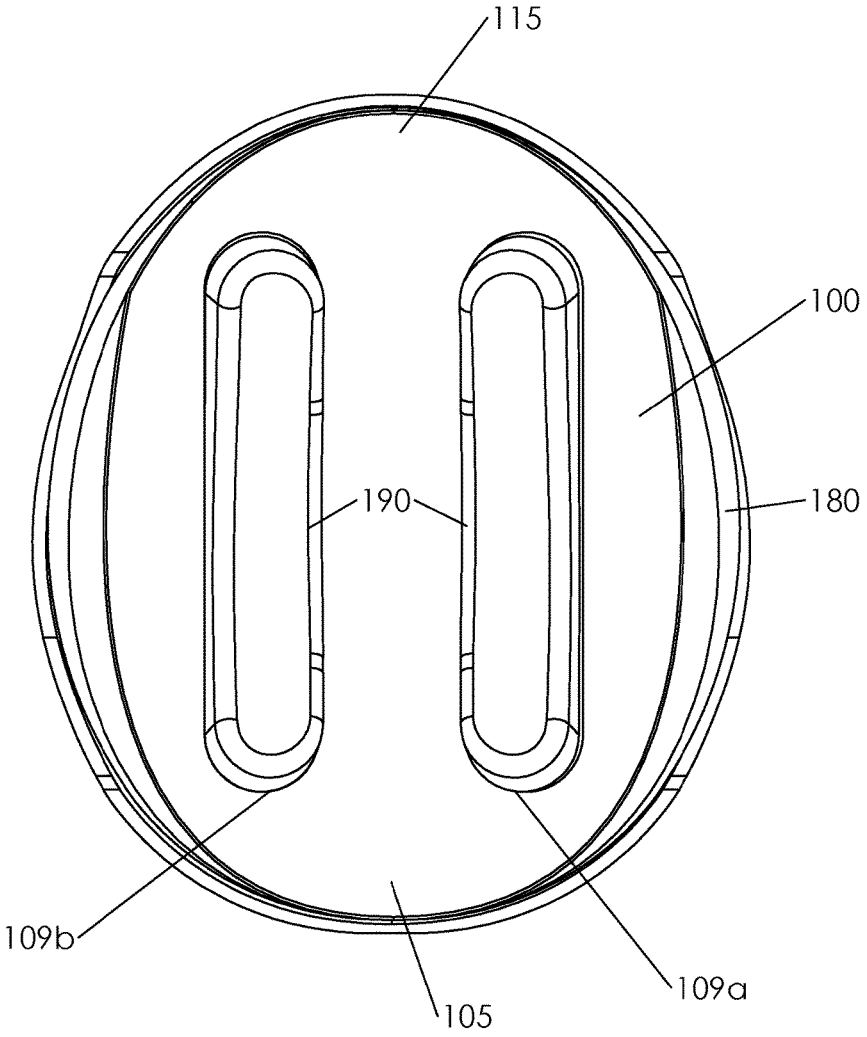
FIG. 2D illustrates a bottom side view of the helmet liner shown in FIG. 1A in conjunction with a helmet and helmet comfort pads.

As shown in FIGS. 2B and 2D, in some implementations, two strips 109*a*, 109*b* of hook and/or loop fasteners (e.g., Velcro®) may be positioned on the interior side of the top portion 110 of the helmet liner 100 and/or the areas adjacent thereto. In this way, the helmet comfort pads 190 may be secured to the interior side of the helmet liner 100 (see, e.g., FIG. 2D). In some implementations, there may be more than two or less than two strips 109 of hook and/or loop fasteners positioned on the interior side of the helmet liner 100 to which the helmet comfort pads 190 may be secured.

In some implementations, the interior side of the helmet liner 100 may include one or more strips 109 of hook and/or loop fasteners positioned anywhere thereon suitable for having helmet comfort pads 190 secured thereto.

In some implementations, when a headset 185 is being used in conjunction with a helmet 180 and a helmet liner 100, the headband 187 of the headset 185 may be sandwiched between the helmet liner 100 and the helmet comfort pads 190 (see, e.g., FIG. 2B). In this way, the headset 185 may be integrated with the helmet 180 and the helmet liner 100. In some implementations, the headset 185 may be prevented from moving about when the headband 187 thereof is sandwiched between the helmet liner 100 and the helmet comfort pads 190.

In some implementations, the one or more strips of hook and/or loop fasteners 107, 109 may be secured to the material of the helmet liner 100 by an adhesive, stitching, and/or any other technique or process known to those of ordinary skill in the art.

To secure a helmet liner 100 between the interior side of a helmet 180 and the helmet comfort pads 190 in conjunction with a headset 185 (see, e.g., FIG. 2A), in some implementations, the following steps may be taken:

Initially, in some implementations, the user may orient and position the helmet liner 100 so that the strips 107 of hook and/or loop fasteners thereon are lined up with corresponding strips 182 of hook and/or loop fasteners positioned on the interior side of the helmet 180 (see, e.g., FIG. 2B).

Then, in some implementations, the helmet liner 100 may be pressed against the interior side of the helmet 180 so that the strips 107 of hook and/or loop fasteners thereon adhere to the corresponding strips 182 of hook and/or loop fasteners positioned on the interior side of the helmet 180 (see, e.g., FIG. 2D).

Next, in some implementations, the headband 187 of the headset 185 may be positioned so that a first end and a second end thereof extend through the first slot 122 and the second slot 127, respectively, of the helmet liner 100. In some implementations, the earcups 188 may then be attached to the headband 187 (see, e.g., FIG. 2C).

Then, in some implementations, the helmet comfort pads 190 may be oriented so that the hook and/or loop fasteners thereon are lined up with the strips 109 of hook and/or loop fasteners positioned on the interior side of the helmet liner 100 (see, e.g., FIG. 2B).

Next, the helmet comfort pads 190 may be pressed against the interior side of the helmet liner 100 so that the hook and/or loop fasteners thereof adhere to the corresponding strips 109 of hook and/or loop fasteners positioned on the interior side of the helmet liner 100 (see, e.g., FIG. 2D).

In this way, a helmet liner 100 may be integrated with a helmet 180 and/or a headset 185.

In some implementations, to remove the helmet liner 100 from between the interior side of the helmet 180 and the helmet comfort pads 190, the above steps may be performed in reverse.

In some implementations, the helmet liner 100 may be manufactured from MAPP® Marino wool. In some implementations, the helmet liner 100 may be manufactured from a polar fleece. In some implementations, the helmet liner 100 may be manufactured from a combination of MAPP® Marino wool and polar fleece. In some implementations, the helmet liner 100 may be manufactured from any synthetic, semi-synthetic, or natural fiber, or combination thereof, suitable for providing localized thermal comfort that is otherwise suitable for use as part of a helmet liner 100. In some implementations, the thermal comfort provided by the helmet liner 100 is achieved by balancing: the insulation value of the material(s) used to make the helmet liner 100, the temperature of the wearer's operating environment, and the activity level of the wearer.

In some implementations, a heating and/or a cooling element may be incorporated into the helmet liner 100 (not shown). In some implementations, a heating and/or a cooling element may not be incorporated into the helmet liner 100.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown, or in sequential order, or that all illustrated operations be performed, to achieve desirable results.

The invention claimed is:

1. A helmet liner comprising:

a piece of material comprising a front portion, a top portion, a back portion, a first side portion, a second side portion, wherein the piece of material has a dome-like shape configured to be worn on the head of a wearer;

a first slot and a second slot, the first slot extends through the first side portion of the piece of material and the second slot extends through the second side portion of the piece of material; and a first strip of fasteners and a second strip of fasteners positioned on an exterior side of the piece of material, the first strip of fasteners and the second strip of fasteners extend from the front portion, over the top portion, to the back portion of the piece of material;

wherein the first slot and the second slot are configured so that a first end and a second end, respectively, of a headband of a headset can pass therethrough; and wherein the first strip of fasteners and the second strip of fasteners are positioned and configured to secure to fasteners positioned on an interior side of a helmet.

2. The helmet liner of claim 1, wherein the first side portion and the second side portion of the helmet liner each extend to cover a first ear and a second ear, respectively, of a wearer.

3. The helmet liner of claim 1, wherein the back portion of the helmet liner extends to cover the nape of a wearer's neck.

4. The helmet liner of claim 1, further comprising two strips of fasteners positioned on an interior side of the piece of material; wherein the two strips of fasteners on the interior side of the helmet liner are each configured to secure to fasteners found on a helmet comfort pad and can be used to position helmet comfort pads on the interior side of the helmet liner.

5. The helmet liner of claim 4, wherein the first side portion and the second side portion of the helmet liner each extend to cover a first ear and a second ear, respectively, of a wearer.

6. The helmet liner of claim 4, wherein the back portion of the helmet liner extends to cover the nape of a wearer's neck.

7. The helmet liner of claim 1, further comprising a third strip of fasteners on the first side portion and a fourth strip of fasteners on the second side portion of the piece of material, the third strip of fasteners is positioned above the first slot and the fourth strip of fasteners is positioned above the second slot; wherein the third strip of fasteners and the fourth strip of fasteners are positioned on the exterior side of the piece of material and configured to secure to fasteners positioned on the interior side of the helmet.

8. The helmet liner of claim 4, further comprising a third strip of fasteners on the first side portion and a fourth strip of fasteners on the second side portion of the piece of material, the third strip of fasteners is positioned above the first slot and the fourth strip of fasteners is positioned above the second slot; wherein the third strip of fasteners and the fourth strip of fasteners are positioned on the exterior side of the piece of material and configured to secure to fasteners positioned on the interior side of the helmet.

9. The helmet liner of claim 1, further comprising a third strip of fasteners and a fourth strip of fasteners on the back portion of the piece of material; wherein the third strip of fasteners and the fourth strip of fasteners are positioned on the exterior side of the piece of material and configured to secure to fasteners positioned on the interior side of the helmet.

10. The helmet liner of claim 4, further comprising a third strip of fasteners and a fourth strip of fasteners on the back portion of the piece of material; wherein the third strip of fasteners and the fourth strip of fasteners are positioned on the exterior side of the piece of material and configured to secure to fasteners positioned on the interior side of the helmet.

11. The helmet liner of claim 7, further comprising a fifth strip of fasteners and a sixth strip of fasteners on the back portion of the piece of material; wherein the fifth strip of fasteners and the sixth strip of fasteners are positioned on the exterior side of the piece of material and configured to secure to fasteners positioned on the interior side of the helmet.

12. A helmet liner comprising:

a piece of material having a dome-like shape that is configured to be worn on the head of a wearer, the piece of material includes a front portion, a top portion, a back portion, a first side portion, a second side portion;

a first slot and a second slot, the first slot extends through the first side portion of the piece of material and the second slot extends through the second side portion of the piece of material; and fasteners positioned on an exterior side of the piece of material, the fasteners are positioned and configured to secure to fasteners positioned on an interior side of a helmet;

wherein the first slot and the second slot are configured so that a first end and a second end, respectively, of a headband of a headset can pass therethrough.

13. The helmet liner of claim 12, wherein the first side portion and the second side portion of the helmet liner each extend to cover a first ear and a second ear, respectively, of a wearer.

14. The helmet liner of claim 12, wherein the back portion of the helmet liner extends to cover the nape of a wearer's neck.

15. The helmet liner of claim 12, further comprising fasteners positioned on an interior side of the piece of material; wherein the fasteners on the interior side of the helmet liner are configured to secure to fasteners found on a helmet comfort pad and can be used to position helmet comfort pads on the interior side of the helmet liner.

16. The helmet liner of claim 15, wherein the first side portion and the second side portion of the helmet liner each extend to cover a first ear and a second ear, respectively, of a wearer.

17. The helmet liner of claim 15, wherein the back portion of the helmet liner extends to cover the nape of a wearer's neck.

* * * * *